United States Patent [19]

Shimosato

[11] 4,449,923

[45] May 22, 1984

[54] CONTINUOUS HEAT-TREATING FURNACE

[75] Inventor: Yoshikazu Shimosato, Yawata, Japan

[73] Assignee: Chugai Ro Kogyo Co., Ltd., Osaka, Japan

[21] Appl. No.: 374,903

[22] Filed: May 4, 1982

[51] Int. Cl.[3] ..... F27D 15/02; F28D 13/00

[52] U.S. Cl. ..... 432/82; 165/104.34

[58] Field of Search ..... 432/82; 165/104.34

[56] References Cited

U.S. PATENT DOCUMENTS

| | | | |
|---|---|---|---|
| 1,705,477 | 3/1929 | Hanley, Jr. | 432/82 |
| 1,792,423 | 2/1931 | Hain | 432/82 |
| 3,336,018 | 8/1967 | Cuvelier | 432/82 |
| 3,925,005 | 12/1975 | Everhardt et al. | 432/82 |

*Primary Examiner*—John J. Camby

*Attorney, Agent, or Firm*—Jackson, Jones & Price

[57] ABSTRACT

A continuous heat-treating furnace comprises, a housing structure having an entrance and an exit defined at its opposite ends, respectively, and also having defined therein a preheating zone adjacent the entrance, a cooling zone adjacent the exit and a high temperature zone intermediate between the preheating and cooling zones, a recirculating duct fluid-connecting a portion of the housing structure in register with the preheating zone to another portion of the housing structure in register with the cooling zone, and a blower for forcibly drawing gas inside the preheating zone and directing it into the cooling zone through the recirculating duct.

18 Claims, 12 Drawing Figures

CONTINUOUS HEAT-TREATING FURNACE

BACKGROUND OF THE INVENTION

The present invention generally relates to a continuous heat-treating furnace and, more particularly to a continuous annealing furnace having a feature of minimizing energy consumption.

A continuous heat-treatment furnace comprising a single unitary housing structure having preheating, high temperature and cooling zones defined therein has long been well known. In this known heat-treatment furnace, various attempts have been made to minimize the energy consumption.

According to, for example, the Japanese Patent Publication No. 45-10610, published in 1970, in order to save the energy the furnace consumes, there is disclosed a continuous heat-treatment furnace having its interior partitioned by a partition wall so as to define therein the path of conveyance of materials to be continuously heat-treated generally in the shape of a figure "U" with the preheating and cooling zones situated on respective sides of the partition wall and extending generally in a parallel relationship to each other. For effecting the heat exchange between the preheating and cooling zones, the top of the partition wall inside the unitary housing structure is spaced a distance from the ceiling wall which overlays both of the preheating and cooling zones.

In this prior art construction, it has been found that, since the atmosphere inside either one of the preheating and cooling zones tends to mix with that inside the other at the same local area within the furnace, heat exchange between these zones does not take place efficiently and effectively and, therefore, a desired or required temperature difference cannot be obtained between the temperature of the materials being treated and that at such local area.

SUMMARY OF THE INVENTION

Accordingly, the present invention has been developed with a view to substantially eliminating the disadvantages inherent in the prior art continuous heat-treatment furnace and has for its essential object to provide an improved continuous heat-treatment furnace in which heat exchange takes place efficiently and effectively between the preheating and cooling zones without creating an uneven temperature distribution inside each of the preheating and cooling zones.

Another important object of the present invention is to provide an improved continuous heat-treatment furnace of the type referred to above, the energy consumption of which is advantageously minimized.

According to the present invention, these objects can be accomplished by providing the continuous heat-treatment furnace with a gas recirculating system extending between the preheating and cooling zones inside the unitary housing structure. This gas recirculating system comprises a recirculating duct extending from a portion of the housing structure in register with the preheating zone to another portion of the housing structure in register with the cooling zone, and a blower for forcibly drawing a gas inside the preheating zone into the cooling zone through the recirculating duct. The recirculating system is positioned exteriorly of the housing structure and so is required in the practice of the present invention for the purpose of creating within the furnace the flow of the gas in one direction counter to the direction of conveyance of the materials being treated.

With the gas recirculating system according to the present invention, the materials loaded successively into the furnace are first preheated in the preheating zone, then heat-treated or annealed in the high temperature zone, and finally cooled in the cooling zone before they are unloaded from the furnace. In preheating the material, a hot gas heated in and flowing from the high temperature zone is utilized. This gas used to preheat the materials, the temperature of which has been reduced as a result of the heat exchange with the materials preheated, is then drawn through the recirculating system into the cooling zone to cool the materials. The temperature of the gas used to cool the material is again increased as it flows into the high temperature zone where a heating device is installed.

In one preferred embodiment of the present invention, the heating is bent generally in the shape of a figure "U". In another preferred embodiment of the present invention, it extends straight.

BRIEF DESCRIPTION OF THE DRAWINGS

The foregoing and other objects and features of the present invention will become apparent from the following description taken in conjunction with preferred embodiments thereof with reference to the accompanying drawings, in which.

DETAILED DESCRIPTION OF THE EMBODIMENTS

Figure 1:
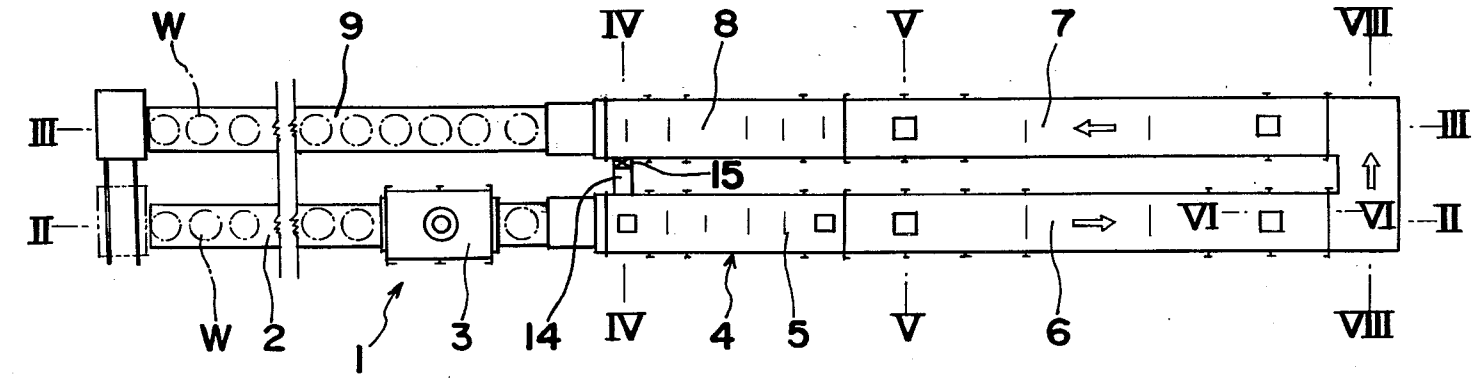
FIG. 1 is a top plan view of a continuous heat-treating furnace according to a first preferred embodiment of the present invention.
Figure 2:
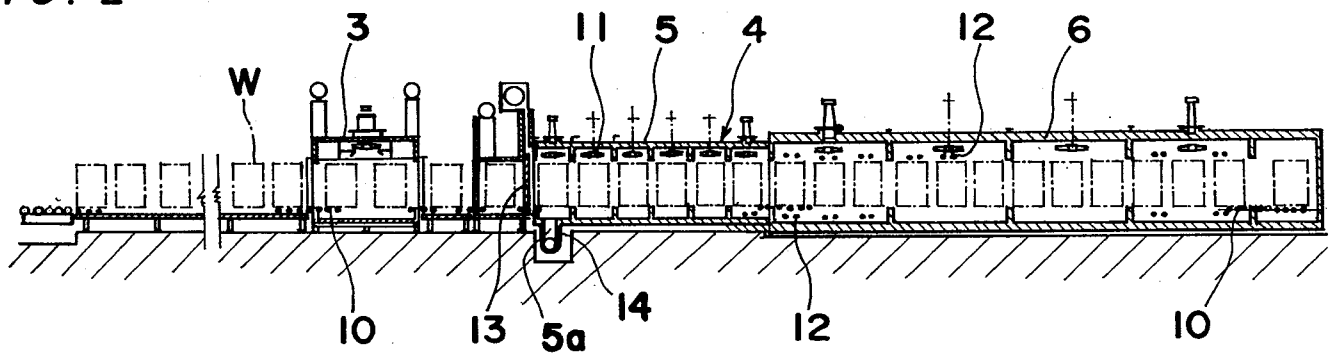
FIGS. 2 and 3 are cross-sectional views taken along the lines II—II and III—III in FIG. 1, respectively.
Figure 3:
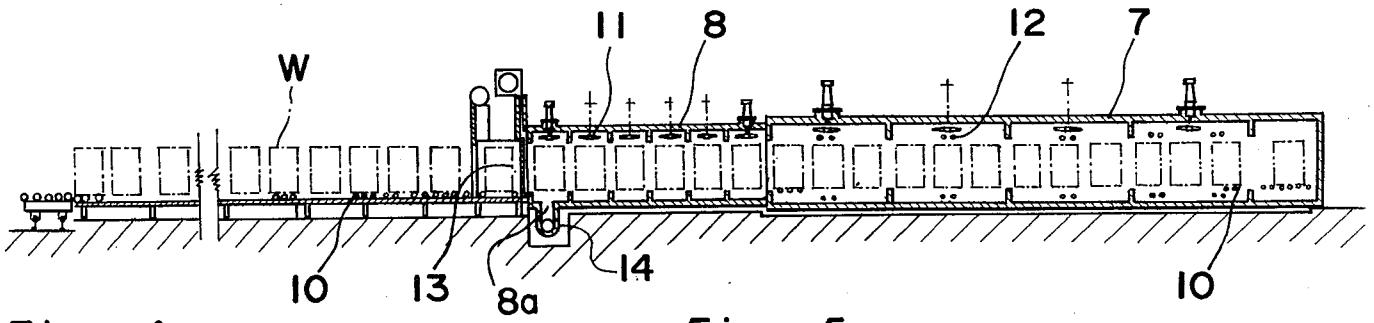
Figure 5:
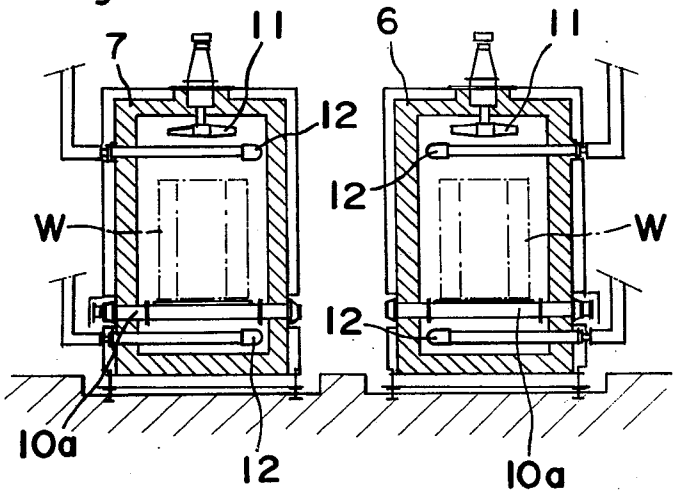
FIGS. 4 and 5 are cross-sectional views, on an enlarged scale, taken along the lines IV—IV and V—V in FIG. 1, respectively.

Before the description of the present invention proceeds, it is to be noted that like parts are designated by like reference numerals throughout the accompanying drawings.

Referring first to FIG. 1 which illustrates a first preferred embodiment of the present invention, a continuous heat-treatment furnace 1 shown therein comprises a loading stock table 2, a drying furnace 3, a single unitary housing structure 4 which includes a preheating zone 5, a high temperature zone 6, a primary cooling zone 7 and a secondary or final cooling zone 8 all defined therein, and an unloading stock table 9. The furnace 1 also comprises a delivery conveyor means 10 extending from the loading stock table 2 to the unloading stock table 9 for transporting materials W to be heat-treated from the loading stock 2 to the unloading stock table 9 successively and sequentially through the drying furnace 3 and the housing structure 4 which may serve as an annealing furnace.

The housing structure 4 has a plurality of spaced convection fans 11 suspended from its ceiling and arranged in a row extending from an entrance of the housing structure 4 adjacent the drying furnace 3 to an exit thereof adjacent the unloading stock table 9. Only the preheating, high temperature and primary cooling zones 5, 6 and 7 within the housing structure 4 have a respective source 12 of heat which may be constituted by a plurality of known radiant tubes supported from the ceiling of the housing structure 4 and also mounted on the floor of the housing structure 4.

It is to be noted that the entrance and exit of the housing structure 4 are adapted to be selectively opened and closed by a respective door 13 for the purpose well known to those skilled in the art.

Figure 4:
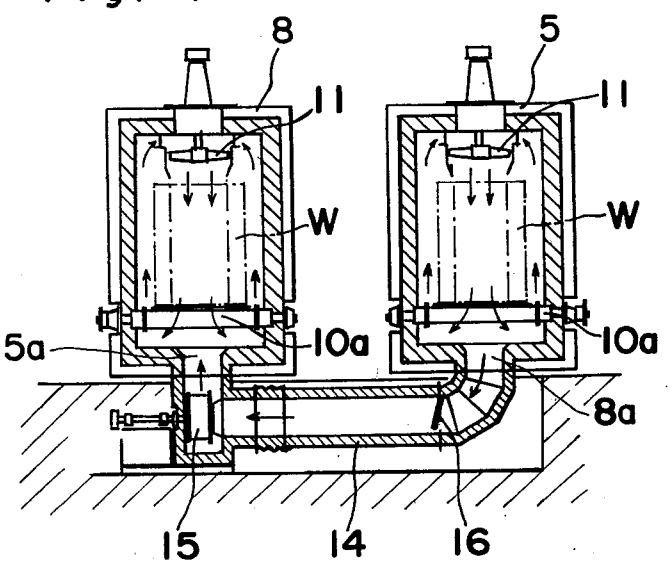
Figure 6:
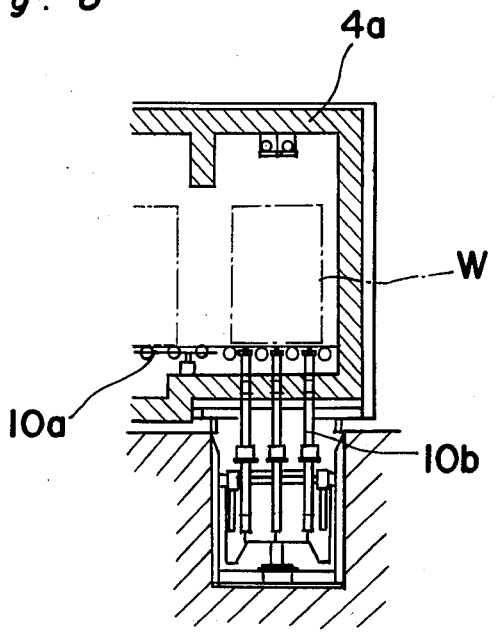
FIG. 6 is a cross-sectional view taken along the line VI—VI in FIG. 1, showing a portion of the furnace on an enlarged scale.

In accordance with the present invention, the entering end of the preheating zone 5 and the discharging end of the final cooling zone 8 communicate with each other through a recirculating duct 14. That is, the recirculating duct 14 has one end opening into a portion 5*a* of the housing structure 4 adjacent the entrance thereof and the other end opening into a portion 8*a* of the housing structure 4 adjacent the exit. This recirculating duct 14, includes, as best shown in FIG. 4, a blower 15 for forcibly drawing a gas inside the preheating zone 5 into the final cooling zone 8 therethrough and a flow control valve 16 for regulating the flow of the gas therethrough. With this recirculating system including the recirculating duct 14, the blower 15 and the flow control valve 16, it will readily be seen that the atmospheric gas inside the housing structure 4 flows in one direction from the high temperature zone 6 to past successively through the preheating zone 5, the recirculating duct 14, the final cooling zone 8 and the primary cooling zone 7 back to the high temperature zone 6.

In the construction as hereinabove described, while the materials W to be heat-treated are transported by means of a plurality of conveyance rollers 10*a* constituting the delivery conveyor means 10, they are moved through the drying furnace 3, then transferred from the loading stock table 2 into the housing structure 4 and finally discharged from the housing structure 4 into the unloading stock table 9. During the movement of the materials W through the housing structure 4, they are heat-treated, i.e., preheated in the preheating zone 5 to a predetermined temperature within the range of about 300° to about 500° C., then heated in the high temperature zone 6 to a predetermined temperature within the range of about 500° to about 800° C., and cooled in the final cooling zone 8 after having slowly cooled in the primary cooling zone 7 down to a predetermined temperature within the range of about 300° to about 500° C.

Figure 10:
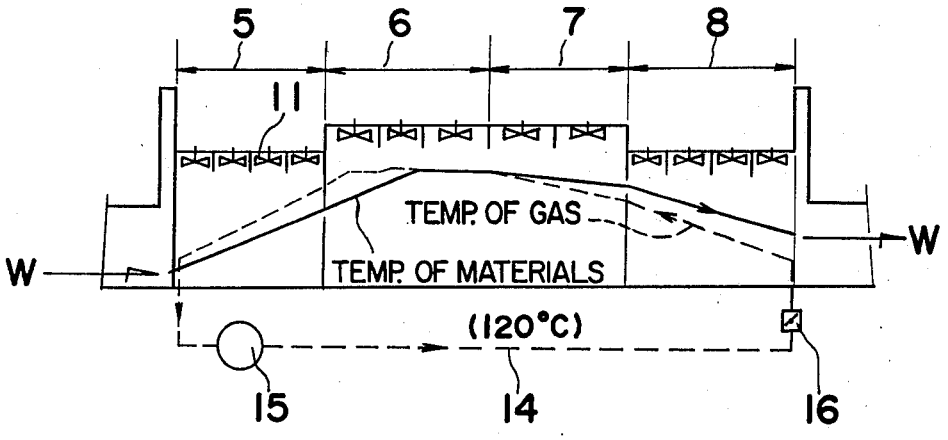
FIG. 10 is a schematic diagram showing the pattern of distribution of temperature inside the furnace together with change in temperature of a recirculated gas.

On the other hand, the atmospheric gas inside the housing structure 4 attains the maximum temperature of about 800° C. in the high temperature zone 6 and, as it flows into the preheating zone 5, the temperature of the gas slowly falls down to about 150° C. as a result of the heat exchange with the materials W loaded into the preheating zone 5. At the time the gas of the lowered temperature is recirculated from the portion 5*a* of the housing structure 4 to the portion 8*a* of the same through the recirculating duct 14, the temperature thereof would be about 130° C., and as it flows into and through the final cooling zone 8, the gas serves to cool down to about 200° C. the materials W which have been transferred from the high temperature zone 6 past the primary cooling zone 7. During the continued flow of the gas, the gas is heated as a result of the heat exchange in the zone 8 and then in the zone 7 to about 800° C. and then heated, as it enters the high temperature zone 6 to a temperature equal to the temperature of the gas inside the high temperature zone 6. This change in temperature of the gas flowing from the final cooling zone 8 towards the preheating zone 5 and that of the materials W being heat-treated in the housing structure 4 are respectively shown by the broken line curve and the solid-line curve in the graph of FIG. 10.

From the foregoing it is clear that, because the atmospheric gas of the maximum temperature in the high temperature zone 6 flows into the preheating zone 5 with its temperature gradually decreasing as it travels from one end of the zone 5 adjacent to the zone 6 to the opposite end of the zone 5 remote from the zone 6 and since a forced convection of flow is created by the convection fans 11 within the housing structure 4 at the same time, a uniform temperature distribution can be attained in the preheating zone 5 in such a way as to depict an ideal temperature curve inclined downwards as the gas travels in the preheating zone 5 away from the high temperature zone 6 while the materials W are heated as a result of the heat exchange in such a way as to depict an ideal temperature curve substantially reverse to that depicted by the gas in the preheating zone 5. In addition, since the gas subsequently flowing through the recirculating duct 14 is of a reduced temperature lower than that it has attained when in the preheating zone 5, little dissipation of heat energies take place and, even if it takes place, no difficulty will arise in cooling of the materials W in the final cooling zone 8.

Figure 11:
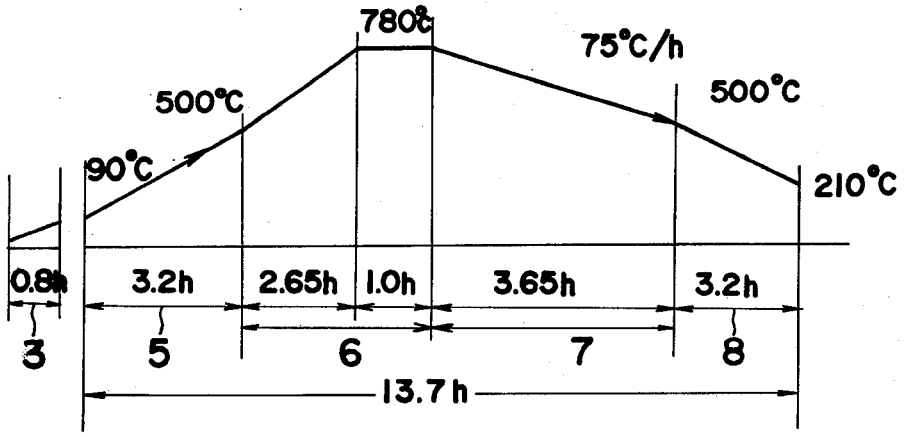
FIG. 11 is a graph showing change in temperature used for the heat-treatment in the furnace.

The atmospheric gas supplied from the preheating zone 5 into the cooling zone 8 through the recirculating duct 14, while forced by the convection fans 11 in the cooling zone 7 to create a forced convection of gas, undergoes heat exchange with the materials W to cool the latter uniformly with the temperature of such gas consequently increasing to a value so approximating the temperature of the gas in the high temperature zone 6 that the latter will not be substantially reduced when it flows from the secondary cooling zone 7 into the high temperature zone 6. In this way, heat energies evolved by the gas inside the housing structure 4 can be effectively and efficiently utilized. One example of the heat cycle in the housing structure 4 is illustrated in FIG. 11, it being, however, to be noted that any desired change of the heat cycle can be achieved by suitably setting the temperature inside the high temperature zone 6 heated by the heat source 12 and/or by adjusting the flow control valve 16 to adjust the rate of flow of the gas being recirculated through the duct 14.

Figure 7:
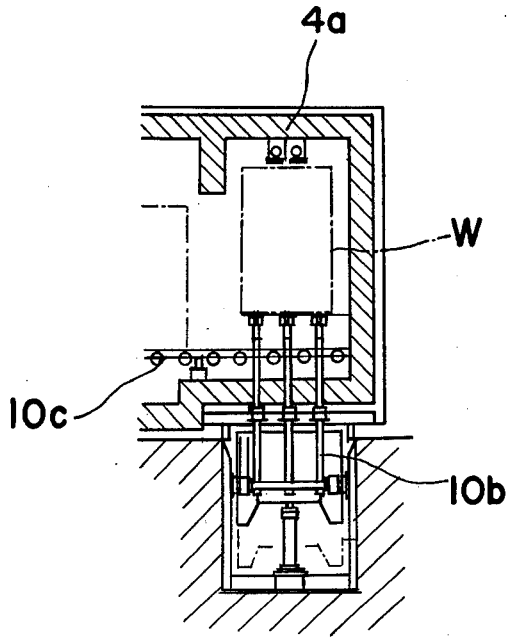
FIG. 7 is a view similar to FIG. 6, showing a pusher mechanism in an operative position different from that shown in FIG. 6.
Figure 8:
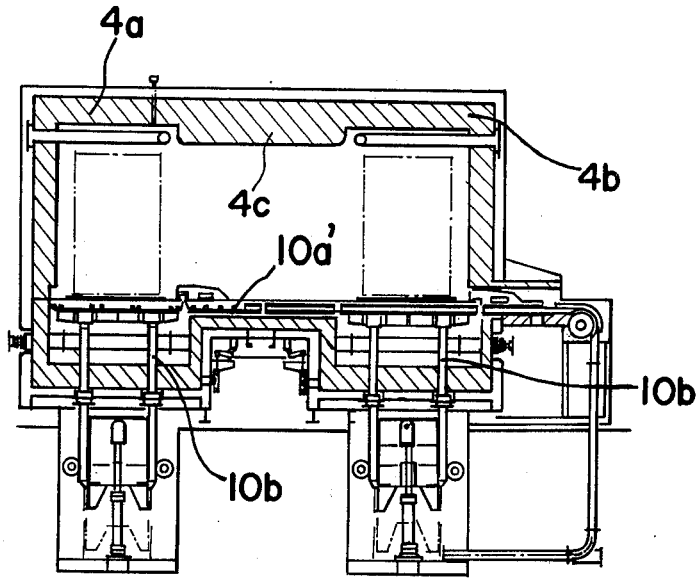
FIG. 8 is a cross-sectional view, on an enlarged scale, taken along the line VIII—VIII in FIG. 1.
Figure 9:
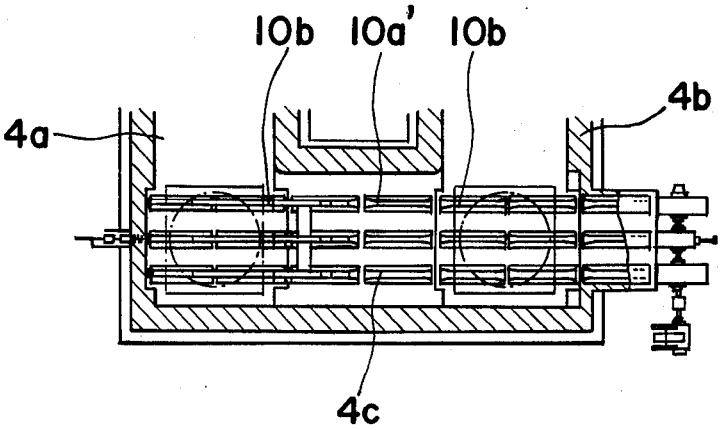
FIG. 9 is a cross-sectional view taken along the line IX—IX in FIG. 8.

In the first embodiment described above, the housing structure 4 is bent to represent a shape generally similar to the shape of a figure "U" such that a portion of the housing structure 4 having the preheating and high temperature zones 5 and 6 and another portion of the same having the primary and final cooling zones 7 and 8 extend spatially in a parallel relationship with each other, the high temperature zone 6 and the primary cooling zone 7 being connected by means of a connecting tunnel 4c forming an integral part of the housing structure 4. At each of the junctions between the high temperature zone 6 and one end of the connecting tunnel 4c and between the primary cooling zone 7 and the opposite end of the connecting tunnel 4c, there is installed a pusher mechanism 10b operable to change the direction of conveyance of the materials W being heat-treated within the housing structure 4, as shown in FIGS. 7 to 9. Specifically, the materials W transported by means of the conveyance rollers 10a in the high temperature zone 6 are brought to a halt temporarily at the tunnel 4c. By the subsequent operation of a cylinder of the lifter mechanism, the material W resting on a carriage is lifted a predetermined distance. At this time, the carriage is engaged with a stop element movable back and forth. This stop element moves on a rail to a position above the lifter mechanism on one side adjacent the primary cooling zone 7, and the material is then transferred on the conveyance rollers 10a in the primary cooling zone 7 by the operation of a cylinder of the second-mentioned lifter mechanism. Thereafter, the succeeding materials W are successively transported from the high temperature zone 6 to the primary cooling zone 7 in the manner as hereinabove described. This arrangement is advantageous in that the recirculating duct 14 may have a minimized length.

The drying furnace 3 may not be utilized. However, the use of the drying furnace 3 is advantageous in that any possible water droplets attaching to the materials W to be heat-treated can be removed. Specifically, if the water droplets are not removed, not only is the atmospheric gas contaminated when they are vaporized within the housing structure 4, but also the materials W being heat-treated tend to be undesirably decarbonized. As a source of heat for the drying furnace 3, a portion of the gas inside the housing structure 4 may be utilized, in which case an energy saving feature can be appreciated in view of the fact that the materials to be heat-treated can be heated to about 60° C. during the passage thereof through the drying furnace and before they are loaded into the housing structure 4.

Figure 12:
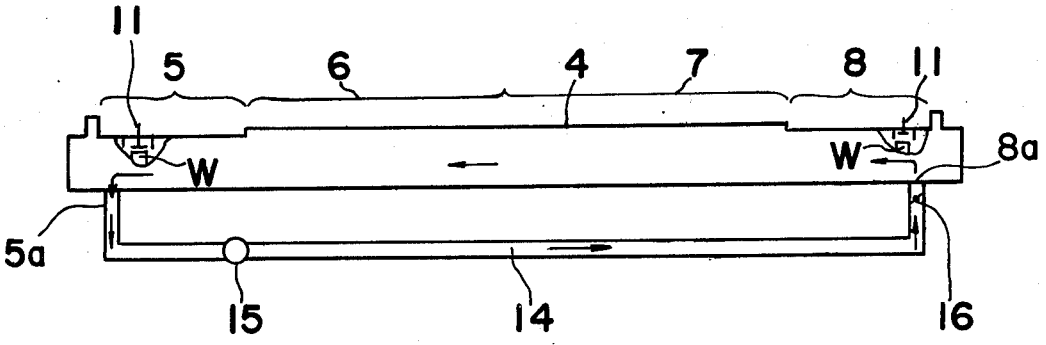
FIG. 12 is a view similar to FIG. 1, showing another preferred embodiment of the present invention.

FIG. 12 illustrates a second preferred embodiment of the present invention. In this embodiment shown therein, the housing structure 4 extends straight with the various zones 5, 6, 7 and 8 arranged in a straight line. In this arrangement, although a longer recirculating duct is required than that used in the foregoing embodiment, the delivery conveyor means 10 used therein may be much simpler than that used in the foregoing embodiment.

From the foregoing description of the present invention, it is clear that, since the gas in the housing structure 4 is recirculated into the housing structure 4 through the recirculating system in a direction counter to the direction of conveyance of the materials W being heat-treated, with a portion of the gas, which has been supplied through the recirculating duct, being used as a coolant gas in the final cooling zone, no extra cooling means, such as, for example, a cooling tube or a blower for supplying a cold gas into the cooling zone, is required. In addition, since the heat exchange takes place efficiently and effectively between the heat produced respectively by the recirculating atmospheric gas and the materials being heat-treated, it has been found that, with the system of the present invention, the amount of heat energy required could be reduced from, for example, 240,000 Kcal/ton to about 160,000 kcal/ton.

Although the present invention has fully been described in connection with the preferred embodiments thereof with reference to the accompanying drawings, it is to be noted that various changes and modifications are apparent to those skilled in the art. By way of example, although the delivery conveyor means has been described as employed in the form of a roller conveyor, it may comprise a belt conveyor or a tray pusher system.

Accordingly, such changes and modifications are to be understood as included within the spirit and scope of the present invention unless they depart therefrom.

I claim:

1. A continous heat-treating furnace comprising:

a housing structure having an entrance and an exit defined at its opposite ends, respectively, and also having defined therein a preheating zone adjacent the entrance, a cooling zone adjacent the exit and a high temperature zone intermediate between the preheating and cooling zones, a recirculating duct providing a fluid connection with a portion of the housing structure approximately adjacent the entrance of the preheating zone to another portion of the housing structure approximatedly adjacent the exit of the cooling zone, and means for forcibly drawing gas from the preheating zone and introducing it into the cooling zone through the recirculating duct.

2. A furnace as claimed in claim 1 wherein said forcibly drawing means comprises a blower.

3. A furnace as claimed in claim 1, having a ceiling in said housing structure, further comprising at least one convection fan supported from the ceiling of the housing structure within each of said preheating, high temperature, and cooling zones.

4. A furnace as claimed in claim 1, wherein the housing structure extends in a straight direction with the preheating, high temperature and cooling zones arranged in line with each other.

5. A furnace as claimed in claim 1, wherein said housing structure is bent to represent a plan shape generally similar to a figure "U" such that a portion of the housing structure having the preheating and high temperature zones and another portion of the housing structure having the cooling zone extend in parallel relationship to each other.

6. A furnace as claimed in claim 2 wherein the housing structure extends in a straight direction with the preheating, high temperature and cooling zones arranged in line with each other.

7. A furnace as claimed in claim 1 wherein the housing structure extends in a straight direction with the preheating, high temperature and cooling zones arranged in line with each other.

8. A furnace as claimed in claim 3 wherein the housing structure extends in a straight direction with the preheating, high temperature and cooling zones arranged in line with each other.

9. A furnace as claimed in claim 2, wherein said housing structure is bent to represent a plan shape generally similar to a figure "U" such that a portion of the housing structure having the preheating and high temperature zones and another portion of the housing structure having the cooling zone extend in parallel relationship to each other.

10. A furnace as claimed in claim 1, wherein said housing structure is bent to represent a plan shape generally similar to a figure "U" such that a portion of the housing structure having the preheating and high temperature zones and another portion of the housing structure having the cooling zone extend in parallel relationship to each other.

11. A furnace as claimed in claim 3, wherein said housing structure is bent to represent a plan shape generally similar to a figure "U" such that a portion of the housing structure having the preheating and high temperature zones and another portion of the housing structure having the cooling zone extend in parallel relationship to each other.

12. A continuous heat-treating furnace comprising:

a housing structure having an entrance for receiving workpieces to be heat-treated and an exit for removing the workpieces, the housing structure having a preheating zone adjacent the entrance, a cooling zone adjacent the exit and a high temperature zone intermediate the preheating and cooling zones;

means for moving workpieces through the housing structure; and means for introducing heat into the high temperature zone and producing a positive flow of hot gas within the housing structure including a duct member extending from approximately the entrance to approximately the exit for conveying gas and means for forcibly drawing gas from the preheating zone through the duct member and introducing it into the cooling zone.

13. The invention of claim 12 further including a plurality of convection fans mounted in the respective zones for assisting a gas flow counter to the movement of the workpieces.

14. The invention of claim 13 wherein the means for moving workpieces includes means for lifting the workpieces within the housing structure.

15. A continuous heat-treating furnace comprising:

a housing structure having an entrance for receiving workpieces to be heat-treated and an exit for removing the workpieces, the housing structure having a preheating zone adjacent the entrance, a cooling zone adjacent the exit and a high temperature zone intermediate the preheating and cooling zones;

means for introducing heat into the high temperature zone; and means for circulating a relatively closed gas flow from the preheating zone to the cooling zone consisting of a duct member extending from approximately the entrance to approximately the exit for conveying gas and means for forcibly drawing gas from the preheating zone through the duct member and introducing it into the cooling zone whereby a gas flow counter to the movement of the workpieces is provided within the housing structure.

16. The invention of claim 15 further including means for conveying the workpieces through the housing structure including means for lifting workpieces between at least one zone to another zone.

17. The invention of claim 15 further including a plurality of convection fans mounted in the respective zones for assisting a gas flow counter to the movement of the workpieces.

18. The invention of claim 15 further including valve means in the duct member for regulating the rate of gas flow.

* * * * *